US008833488B2

(12) United States Patent
Knudsen et al.

(10) Patent No.: US 8,833,488 B2
(45) Date of Patent: Sep. 16, 2014

(54) AUTOMATIC STANDPIPE PRESSURE CONTROL IN DRILLING

(75) Inventors: Kjetil A. Knudsen, Bronnoysund (NO); Fredrik Varpe, Stavanger (NO)

(73) Assignee: Halliburton Energy Services, Inc., Houston, TX (US)

( * ) Notice: Subject to any disclaimer, the term of this patent is extended or adjusted under 35 U.S.C. 154(b) by 80 days.

(21) Appl. No.: 13/423,366

(22) Filed: Mar. 19, 2012

(65) Prior Publication Data

US 2012/0255776 A1 Oct. 11, 2012

(30) Foreign Application Priority Data

Apr. 8, 2011 (WO) ..... PCT/US2011/031767

(51) Int. Cl.

| | |
|---|---|
| ***E21B 21/08*** | (2006.01) |
| ***E21B 21/10*** | (2006.01) |
| ***E21B 34/02*** | (2006.01) |
| ***E21B 44/00*** | (2006.01) |
| ***E21B 33/035*** | (2006.01) |

(52) U.S. Cl.

CPC ..... *E21B 21/08* (2013.01); *E21B 44/00* (2013.01); *E21B 33/0355* (2013.01)

USPC ..... 175/25; 175/48; 166/373; 166/370; 166/91.1

(58) Field of Classification Search

USPC ..... 175/25, 48; 166/373, 370, 91.1

See application file for complete search history.

(56) References Cited

U.S. PATENT DOCUMENTS

| | | | | |
|---|---|---|---|---|
| 3,362,487 | A * | 1/1968 | Lindsey | 175/38 |
| 3,387,851 | A | 6/1968 | Cugini | |
| 3,429,385 | A * | 2/1969 | Baugh et al. | 175/25 |
| 3,443,643 | A * | 5/1969 | Jones | 175/25 |
| 3,552,502 | A | 1/1971 | Wilson | |
| 3,603,409 | A | 9/1971 | Watkins | |
| 3,677,353 | A * | 7/1972 | Baker | 175/25 |
| 3,815,673 | A | 6/1974 | Bruce et al. | |

(Continued)

FOREIGN PATENT DOCUMENTS

| | | |
|---|---|---|
| EP | 0881357 A2 | 12/1998 |
| EP | 1071862 B1 | 1/2001 |

(Continued)

OTHER PUBLICATIONS

Society of Petroleum Engineers, SPE 85310, dated Oct. 20-22, 2003, 12 pages.

(Continued)

*Primary Examiner* — Jennifer H Gay
(74) *Attorney, Agent, or Firm* — Smith IP Services, P.C.

(57) ABSTRACT

A method of controlling standpipe pressure in a drilling operation can include comparing a measured standpipe pressure to a desired standpipe pressure, and automatically adjusting a choke in response to the comparing, thereby reducing a difference between the measured standpipe pressure and the desired standpipe pressure. A standpipe pressure control system for use in a drilling operation can include a controller which outputs an annulus pressure setpoint based on a comparison of a measured standpipe pressure to a desired standpipe pressure, and a choke which is automatically adjusted in response to the annulus pressure setpoint. A well system can include a standpipe line connected to a drill string in a wellbore, a sensor which measures pressure in the standpipe line, and a controller which outputs an annulus pressure setpoint based at least in part on a difference between the measured pressure and a desired standpipe pressure.

17 Claims, 4 Drawing Sheets

(56) References Cited

U.S. PATENT DOCUMENTS 3,827,511 A * 8/1974 Jones ..... 175/25
3,971,926 A * 7/1976 Gau et al. ..... 708/3
4,046,191 A 9/1977 Neath
4,063,602 A 12/1977 Howell et al.
4,091,881 A 5/1978 Maus
4,099,583 A 7/1978 Maus
4,194,567 A 3/1980 Marais
4,234,043 A 11/1980 Roberts
4,291,772 A 9/1981 Beynet
4,355,784 A 10/1982 Cain
4,436,157 A 3/1984 Brooks
4,468,056 A 8/1984 Kramer et al.
4,502,534 A 3/1985 Roche et al.
4,626,135 A 12/1986 Roche
4,682,913 A 7/1987 Shatto et al.
4,685,521 A 8/1987 Raulins
4,813,495 A 3/1989 Leach
4,832,126 A 5/1989 Roche
4,880,060 A 11/1989 Schwendemann et al.
5,006,845 A 4/1991 Calcar et al.
5,154,078 A 10/1992 Codazzi
5,303,582 A 4/1994 Miska
5,444,619 A 8/1995 Hoskins et al.
5,720,356 A 2/1998 Gardes
5,771,974 A 6/1998 Stewart et al.
5,934,371 A 8/1999 Bussear et al.
6,002,985 A 12/1999 Stephenson
6,012,015 A 1/2000 Tubel
6,021,377 A 2/2000 Dubinsky et al.
6,035,952 A 3/2000 Bradfield et al.
6,053,252 A 4/2000 Edwards
6,065,550 A 5/2000 Gardes
6,101,447 A 8/2000 Poe, Jr.
6,102,673 A 8/2000 Mott et al.
6,125,936 A 10/2000 Swisher
6,138,774 A 10/2000 Bourgoyne, Jr. et al.
6,173,768 B1 1/2001 Watson
6,230,824 B1 5/2001 Peterman et al.
6,263,982 B1 7/2001 Hannegan et al.
6,273,193 B1 8/2001 Hermann et al.
6,325,159 B1 12/2001 Peterman et al.
6,328,107 B1 12/2001 Maus
6,450,262 B1 9/2002 Regan
6,454,022 B1 9/2002 Sangesland et al.
6,457,540 B2 10/2002 Gardes
6,470,975 B1 10/2002 Bourgoyne et al.
6,474,422 B2 11/2002 Schubert et al.
6,484,816 B1 11/2002 Koederitz
6,527,062 B2 3/2003 Elkins et al.
6,571,873 B2 6/2003 Maus
6,585,044 B2 7/2003 Rester et al.
6,598,682 B2 7/2003 Johnson et al.
6,662,110 B1 12/2003 Bargach et al.
6,668,943 B1 12/2003 Maus et al.
6,702,012 B2 3/2004 Bailey et al.
6,732,798 B2 5/2004 Johnson et al.
6,732,804 B2 5/2004 Hosie et al.
6,739,397 B2 5/2004 Ayling
6,745,857 B2 6/2004 Gjedebo
6,802,379 B2 10/2004 Dawson et al.
6,814,140 B2 11/2004 Robichaux
6,820,702 B2 11/2004 Niedermayr et al.
6,840,322 B2 1/2005 Haynes et al.
6,853,921 B2 2/2005 Thomas et al.
6,854,532 B2 2/2005 Fincher et al.
6,892,812 B2 5/2005 Niedermayr et al.
6,901,391 B2 5/2005 Storm, Jr. et al.
6,904,981 B2 6/2005 van Riet
6,913,092 B2 7/2005 Bourgoyne et al.
6,920,085 B2 7/2005 Finke et al.
6,920,942 B2 * 7/2005 Koederitz ..... 175/25
6,926,101 B2 8/2005 deBoer
6,981,561 B2 1/2006 Kruger et al.
7,023,691 B1 4/2006 Feight et al.
7,032,691 B2 4/2006 Humphreys
7,040,394 B2 5/2006 Bailey et al.
7,044,237 B2 5/2006 Leuchtenberg
7,055,627 B2 6/2006 Fontana et al.
7,073,591 B2 7/2006 Massie et al.
7,079,952 B2 7/2006 Thomas et al.
7,080,685 B2 7/2006 Bailey et al.
7,090,036 B2 8/2006 DeBoer
7,093,662 B2 8/2006 De Boer
7,096,975 B2 8/2006 Aronstam et al.
7,114,571 B2 10/2006 Gatherar et al.
7,134,489 B2 11/2006 Van Riet
7,158,886 B2 1/2007 Hou et al.
7,159,669 B2 1/2007 Bourgoyne et al.
7,165,610 B2 1/2007 Hopper
7,174,975 B2 2/2007 Krueger et al.
7,185,718 B2 3/2007 Gardes
7,185,719 B2 3/2007 van Riet
7,201,231 B2 4/2007 Chaplin et al.
7,207,399 B2 4/2007 Duhe et al.
7,237,613 B2 7/2007 Radi et al.
7,237,623 B2 7/2007 Hannegan
7,258,171 B2 8/2007 Bourgoyne et al.
7,264,058 B2 9/2007 Fossli
7,270,185 B2 9/2007 Fontana et al.
7,278,496 B2 10/2007 Leuchtenberg
7,281,593 B2 10/2007 Steiner et al.
7,350,597 B2 4/2008 Reitsma et al.
7,353,887 B2 4/2008 Krueger et al.
7,367,410 B2 5/2008 Sangesland
7,367,411 B2 5/2008 Leuchtenberg
7,395,878 B2 7/2008 Reitsma et al.
7,407,019 B2 * 8/2008 Kinder et al. ..... 175/38
7,487,837 B2 2/2009 Bailey et al.
7,497,266 B2 3/2009 Fossli
7,513,310 B2 4/2009 Fossli
7,562,723 B2 7/2009 Reitsma
7,610,251 B2 10/2009 Shayegi et al.
7,650,950 B2 1/2010 Leuchtenberg
7,658,228 B2 2/2010 Moksvold
7,677,329 B2 3/2010 Stave
7,699,109 B2 4/2010 May et al.
7,708,064 B2 5/2010 Sehsah
7,721,822 B2 5/2010 Krueger et al.
7,806,203 B2 10/2010 Krueger et al.
7,913,774 B2 3/2011 Partouche
7,926,593 B2 4/2011 Bailey et al.
7,997,345 B2 8/2011 Hannegan
8,201,628 B2 * 6/2012 Lovorn et al. ..... 166/292
8,322,432 B2 12/2012 Bailey et al.
2002/0011338 A1 1/2002 Maurer et al.
2002/0092655 A1 7/2002 Fincher et al.
2002/0108783 A1 8/2002 Elkins et al.
2002/0112888 A1 8/2002 Leuchtenberg
2003/0066650 A1 4/2003 Fontana et al.
2003/0079912 A1 5/2003 Leuchtenberg
2003/0089498 A1 5/2003 Johnson et al.
2003/0098181 A1 5/2003 Aronstam et al.
2003/0106712 A1 6/2003 Bourgoyne et al.
2003/0110017 A1 6/2003 Guthrie et al.
2003/0111799 A1 6/2003 Gilmore
2003/0127230 A1 7/2003 von Eberstein, Jr. et al.
2003/0139916 A1 7/2003 Choe et al.
2003/0170077 A1 9/2003 Herd et al.
2003/0220742 A1 11/2003 Niedermayr et al.
2003/0234120 A1 12/2003 Paluch et al.
2004/0040746 A1 3/2004 Niedermayer et al.
2004/0065440 A1 4/2004 Farabee et al.
2004/0124008 A1 7/2004 Fincher et al.
2004/0206548 A1 10/2004 Aronstam et al.
2005/0061546 A1 3/2005 Hannegan
2005/0092522 A1 5/2005 Humphreys
2005/0092523 A1 5/2005 McCaskill et al.
2005/0096848 A1 * 5/2005 Hou et al. ..... 702/9
2005/0098349 A1 5/2005 Krueger et al.
2005/0252286 A1 11/2005 Ibrahim et al.
2006/0006004 A1 1/2006 Terry et al.
2006/0021755 A1 2/2006 Radi et al.
2006/0065402 A9 3/2006 Fontana et al.
2006/0070772 A1 4/2006 De Boer et al.

(56) References Cited

U.S. PATENT DOCUMENTS

| | | | | |
|---|---|---|---|---|
| 2006/0086538 | A1 | 4/2006 | Van Riet | |
| 2006/0100836 | A1 | 5/2006 | Singh | |
| 2006/0102387 | A1 | 5/2006 | Bourgoyne et al. | |
| 2006/0124300 | A1 | 6/2006 | Steiner et al. | |
| 2006/0169491 | A1 | 8/2006 | Fossli | |
| 2006/0185857 | A1 | 8/2006 | York et al. | |
| 2006/0191716 | A1 | 8/2006 | Humphreys | |
| 2006/0207795 | A1* | 9/2006 | Kinder et al. | 175/38 |
| 2007/0068704 | A1 | 3/2007 | Krueger et al. | |
| 2007/0168056 | A1 | 7/2007 | Shayegi et al. | |
| 2007/0240875 | A1 | 10/2007 | Van Riet | |
| 2007/0278007 | A1 | 12/2007 | Krueger et al. | |
| 2008/0041149 | A1 | 2/2008 | Leuchtenberg | |
| 2008/0060846 | A1 | 3/2008 | Belcher et al. | |
| 2008/0105434 | A1 | 5/2008 | Orbell et al. | |
| 2009/0101351 | A1 | 4/2009 | Hannegan | |
| 2009/0139724 | A1 | 6/2009 | Gray et al. | |
| 2009/0159334 | A1 | 6/2009 | Alberty | |
| 2009/0211239 | A1 | 8/2009 | Askeland | |
| 2010/0006297 | A1 | 1/2010 | Stave | |
| 2010/0018715 | A1 | 1/2010 | Orbell et al. | |
| 2011/0009298 | A1 | 1/2011 | Dobson, Jr. et al. | |
| 2011/0024189 | A1* | 2/2011 | Saeed et al. | 175/40 |
| 2011/0139464 | A1* | 6/2011 | Henderson et al. | 166/370 |
| 2011/0139506 | A1* | 6/2011 | Lovorn et al. | 175/25 |
| 2011/0139509 | A1* | 6/2011 | Pool et al. | 175/50 |
| 2011/0214882 | A1* | 9/2011 | Santos | 166/373 |
| 2011/0259612 | A1* | 10/2011 | Lovorn et al. | 166/387 |
| 2011/0290562 | A1* | 12/2011 | Standifird et al. | 175/57 |
| 2012/0061087 | A1* | 3/2012 | Iblings et al. | 166/316 |
| 2012/0103610 | A1* | 5/2012 | Turner et al. | 166/290 |
| 2012/0165997 | A1 | 6/2012 | Lewis et al. | |
| 2012/0186873 | A1* | 7/2012 | Shayegi et al. | 175/25 |
| 2012/0241217 | A1* | 9/2012 | Davis et al. | 175/26 |
| 2012/0255777 | A1* | 10/2012 | Bernard | 175/25 |
| 2012/0285744 | A1* | 11/2012 | Bernard | 175/57 |

FOREIGN PATENT DOCUMENTS

| | | | |
|---|---|---|---|
| EP | 1240404 | B1 | 9/2002 |
| EP | 1432887 | B1 | 3/2003 |
| EP | 1488073 | B1 | 8/2003 |
| EP | 1356186 | B1 | 10/2003 |
| EP | 1595057 | B1 | 9/2004 |
| EP | 1664478 | B1 | 2/2005 |
| EP | 1356186 | B1 | 6/2005 |
| EP | 1659260 | A2 | 5/2006 |
| EP | 1907664 | A1 | 4/2008 |
| EP | 1917444 | A1 | 5/2008 |
| EP | 1936112 | A2 | 6/2008 |
| EP | 1969204 | A2 | 9/2008 |
| EP | 2053196 | A1 | 4/2009 |
| EP | 2150681 | A1 | 2/2010 |
| EP | 2171207 | A1 | 4/2010 |
| EP | 2179127 | A1 | 4/2010 |
| EP | 2231997 | A2 | 9/2010 |
| GB | 2229787 | A | 10/1990 |
| WO | 9942696 | A1 | 8/1999 |
| WO | 0165060 | A1 | 9/2001 |
| WO | 0183941 | A1 | 11/2001 |
| WO | 0190528 | A1 | 11/2001 |
| WO | 0206634 | A1 | 1/2002 |
| WO | 0244518 | A1 | 6/2002 |
| WO | 0250398 | A1 | 6/2002 |
| WO | 03025334 | A8 | 3/2003 |
| WO | 03025336 | A1 | 3/2003 |
| WO | 03071091 | A9 | 8/2003 |
| WO | 2004005667 | A1 | 1/2004 |
| WO | 2004074627 | A1 | 9/2004 |
| WO | 2004085788 | A3 | 10/2004 |
| WO | 2005001237 | A1 | 1/2005 |
| WO | 2005017308 | A1 | 2/2005 |
| WO | 2005042917 | A1 | 5/2005 |
| WO | 2006029379 | A1 | 3/2006 |
| WO | 2006031119 | A1 | 3/2006 |
| WO | 2006099362 | A1 | 9/2006 |
| WO | 2006118920 | A3 | 11/2006 |
| WO | 2006138565 | A1 | 12/2006 |
| WO | 2007008085 | A1 | 1/2007 |
| WO | 2007016000 | A1 | 2/2007 |
| WO | 2007030017 | A1 | 3/2007 |
| WO | 2007081711 | A3 | 7/2007 |
| WO | 2007112291 | A3 | 10/2007 |
| WO | 2007124330 | A3 | 11/2007 |
| WO | 2008133523 | A1 | 11/2008 |
| WO | 2008134266 | A1 | 11/2008 |
| WO | 2008151128 | A9 | 12/2008 |
| WO | 2008156376 | A1 | 12/2008 |
| WO | 2009017418 | A1 | 2/2009 |
| WO | 2009018448 | A2 | 2/2009 |
| WO | 2009058706 | A2 | 5/2009 |
| WO | 2009086442 | A3 | 7/2009 |
| WO | 2009111412 | A1 | 9/2009 |
| WO | 2009111412 | A2 | 9/2009 |
| WO | 2009123476 | A1 | 10/2009 |
| WO | 2010065646 | A3 | 6/2010 |
| WO | 2010071656 | A1 | 6/2010 |
| WO | 2010095947 | A1 | 8/2010 |
| WO | 2011043764 | A1 | 4/2011 |

OTHER PUBLICATIONS

Society of Petroleum Engineers, SPE 72058, dated May 25-26, 2001, 6 pages.

Shell; "Full-Scale Automated Choke Manifold," presentation dated Apr. 20, 2005, 22 pages.

Witold Pedrycz; "From Granular Computing to Computational Intelligence and Human-centric Systems," IEEE Computational Intelligence Society, May 2005, pp. 6-11, 6 pages.

@Balance; "Dynamic Annular Pressure Control," dated 2005, 1 page.

Nils-Olav Skeie, et al.; "Early detection of Hydrocarbon liquid to surface during MPD operations," dated 2006, 1 page.

Press release, "Impact Solutions Group and Drilling Systems Team Up to Offer the Secure DrillingTM Managed Pressure Drilling System to the Industry," dated Oct. 21, 2004, 2 pages.

International Preliminary Report on Patentability issued for International Patent Application No. PCT/US07/60001, dated Sep. 12, 2008, 14 pages.

Office Action issued Mar. 26, 2008 for U.S. Appl. No. 11/333,768, 97 pages.

Office Action issued Sep. 22, 2008 for U.S. Appl. No. 11/333,768, 72 pages.

International Search Report with Written Opinion issued for International Patent Application No. PCT/US07/60001, dated Jul. 18, 2008, 15 pages.

Kishan Mehrotra, et al., "Elements of Artificial Neural Networks," MIT Press, pp. 70-78, dated 1997, 11 pages.

Corrado Mencar, "Theory of Fuzzy Information Granulation: Contributions to Interpretability Issues," University of Bari, pp. 3-8,19, and 211-214, dated Dec. 2004, 12 pages.

Search Report issued Feb. 8, 2012 for International Application No. PCT/US11/31767, 5 pages.

Written Opinion issued Feb. 8, 2012 for International Application No. PCT/US11/31767, 4 pages.

US 6,708,780, 3/2004, Bourgoyne et al. (withdrawn).

International Search Report ad Written Opinion issued Sep. 22, 2008, for International Patent Application Serial No. PCT/US07/83974, 16 pages.

International Search Report and Written Opinion issued Feb. 12, 2009, for International Patent Application Serial No. PCT/US08/87686, 7 pages.

International Preliminary Report on Patentability issued May 22, 2009, for International Patent Application Serial No. PCT/US07/83974, 13 pages.

International Search Report with Written Opinion issued Oct. 13, 2010 for PCT Patent Application No. PCT/US10/020122, 13 pages.

International Search Report with Written Opinion issued Jun. 17, 2011 for PCT Patent Application No. PCT/US10/056433, 9 pages.

(56) References Cited

OTHER PUBLICATIONS

International Search Report with Written Opinion issued Dec. 21, 2011 for PCT Patent Application No. PCT/US11/031790, 15 pages.
International Search Report with Written Opinion issued Feb. 17, 2012 for PCT Patent Application No. PCT/US11/043750, 11 pages.
Mi Swaco; "10k Super AutoChoke", product bulletin MS-04104, dated Aug. 2004, 4 pages.
IADC Well Control Europe; "Well Control in an Increasingly Complex and Changing Environment", Conference and Exhibition 2010, dated Apr. 13-14, 2010, 4 pages.
Office Action issued Sep. 16, 2011 for U.S. Appl. No. 12/299,411, 23 pages.
Office Action issued Feb. 7, 2012 for U.S. Appl. No. 13/022,964, 15 pages.
International Search Report with Written Opinion issued Feb. 8, 2012 for PCT Patent Application No. PCT/US11/031767, 9 pages.
Chinese Office Action issued Feb. 22, 2012 for CN Patent Application No. 200780049409.0, 4 pages.
English Translation of Chinese Office Action issued Feb. 22, 2012 for CN Patent Application No. 200780049409.0, 4 pages.
Office Action issued Mar. 14, 2012 for U.S. Appl. No. 12,299,411, 36 pages.
Great Britain Examination Report issued Apr. 12, 2012 for GB Patent Application No. 1108380.5, 2 pages.
Liv Almas Carlsen, et al.; "Automatic Coordination of Equipment while Circulating out a Kick and Displacing the Kill-Weight Mud", IRIS IADC Well Control Europe presentation, dated 2010, 41 pages.
Australian Office Action issued Oct. 5, 2010 for AU Patent Application No. 2007317276, 2 pages.
Pre-Interview First Office Action issued Jul. 14, 2010 for U.S. Appl. No. 11/936,411, 14 pages.
International Search Report with Written Opinion issued Jan. 25, 2011 for PCT Patent Application No. PCT/US10/032578, 9 pages.
International Preliminary Report with Patentability issued Jun. 30, 2011 for PCT Patent Application No. PCT/US08/087686, 6 pages.
International Preliminary Report on Patentability issued Feb. 9, 2012 for PCT Patent Application No. PCT/US09/052227, 7 pages.
International Search Report with Written Opinion issued Nov. 21, 2011 for PCT Patent Application No. PCT/US11/036616, 13 pages.
Office Action issued Nov. 25, 2011 for U.S. Appl. No. 13/084,841, 19 pages.
International Search Report with Written Opinion issued Dec. 13, 2011 for PCT Patent Application No. PCT/US11/035751, 16 pages.
Singapore Examination Report issued Dec. 27, 2011 for SG Patent Application No. 200903022-2, 8 pages.
Office Action issued Jan. 24, 2012 for U.S. Appl. No. 12/638,012, 18 pages.
Search Report with Written Opinion issued Nov. 21, 2011 for PCT Patent Application No. PCT/US11/36616, 13 pages.
Singapore Written Opinion issued May 17, 2010, for SG Patent Application Serial No. 2009030222, 2 pages.
Office Action issued Feb. 25, 2011 for U.S. Appl. No. 11/936,411, 66 pages.
Office Action issued Jul. 14, 2010 for U.S. Appl. No. 11/936,411, 16 pages.
Pre-Interview Office Action issued Jul. 29, 2010 for U.S. Appl. No. 11/936,411, 3 pages.
Office Action issued Mar. 14, 2012 for U.S. Appl. No. 12/299,411, 36 pages.
Office Action issued Oct. 7, 2013 for U.S. Appl. No. 13/542,892, 58 pages.
Office Action issued Oct. 18, 2013 for U.S. Appl. No. 13/542,781, 36 pages.
Office Action issued Oct. 29, 2013 for U.S. Appl. No. 13/542,875, 53 pages.
Singapore Office Action issued Feb. 15, 2011 for SG Patent Application No. 200903022-2, 9 pages.
Australian Examiner's Report issued Mar. 7, 2011 for AU Patent Application No. 2007317276, 2 pages.
Australian Examiner's Report issued Sep. 28, 2012 for AU Patent Application No. 2008365249, 3 pages.
Office Action issued Oct. 11, 2012 for U.S. Appl. No. 13/492,688, 17 pages.
Chinese Office Action issued Nov. 13, 2012 for CN Patent Application No. 200780049409.0, 3 pages.
English translation of Chinese Office Action issued Nov. 13, 2012 for CN Patent Application No. 200780049409.0, 5 pages.
GE Oil & Gas; "Hydril Pressure Control K Pulsation Dampeners", Drilling and Production article, dated Aug. 6, 2010, 2 pages.
Specification and Drawings for U.S. Appl. No. 13/649,571, filed Oct. 11, 2012, 63 pages.
Office Action issued Dec. 5, 2013 for U.S. Appl. No. 13/542,856, 13 pages.
Office Action issued Dec. 24, 2013 for U.S. Appl. No. 13/542,892, 10 pages.
Smith Services; "Marine Riser RCD", product presentation, dated Jul. 2009, 18 pages.
Weatherford International Ltd.; "Weatherford Model 7800 Rotating Control Device", article No. 4593.00, dated 2007, 5 pages.
Weatherford International Ltd.; "Model 7875 Rotating Control Device", article No. 4594.01, dated 2010, 4 pages.
Hannegan, Don; Weatherford International; "Offshore Drilling Hazard Mitigation: Controlled Pressure Drilling Redefines What is Drillable", Managed Pressure Drilling Magazine, Drilling Contractor article, dated Jan.-Feb. 2009, 4 pages.
Smith Services; "Hold 2500 Rotating Control Device", product brochure, article No. ss-04-0055, dated 2004, 4 pages.
Office Action issued Feb. 3, 2014 for U.S. Appl. No. 12/299,411, 63 pages.
International Search Report and Written Opinion issued Jul. 27, 2011 for PCT Patent Application No. PCT/US2010/062394, 10 pages.
Office Action issued Apr. 17, 2013 for U.S. Appl. No. 13/542,781, 10 pages.
Office Action issued May 31, 2013 for U.S. Appl. No. 13/542,875, 10 pages.
Office Action issued May 5, 2013 for U.S. Appl. No. 13/542,892, 12 pages.

* cited by examiner

AUTOMATIC STANDPIPE PRESSURE CONTROL IN DRILLING

CROSS-REFERENCE TO RELATED APPLICATION

This application claims the benefit under 35 USC §119 of the filing date of International Application Serial No. PCT/US11/31767 filed 8 Apr. 2011. The entire disclosure of this prior application is incorporated herein by this reference.

BACKGROUND

The present disclosure relates generally to equipment utilized and operations performed in conjunction with a subterranean well and, in an embodiment described herein, more particularly provides for automatic standpipe pressure control in drilling.

In managed pressure drilling and underbalanced drilling, pressure in a wellbore is precisely controlled by, for example, controlling pressure in an annulus at or near the earth's surface. However, in some circumstances (such as in well control situations, etc.) it may be desirable to control wellbore pressure by controlling pressure in a standpipe connected to a drill string.

Therefore, it will be appreciated that advancements are needed in the art of wellbore pressure control.

DETAILED DESCRIPTION

Figure 1:
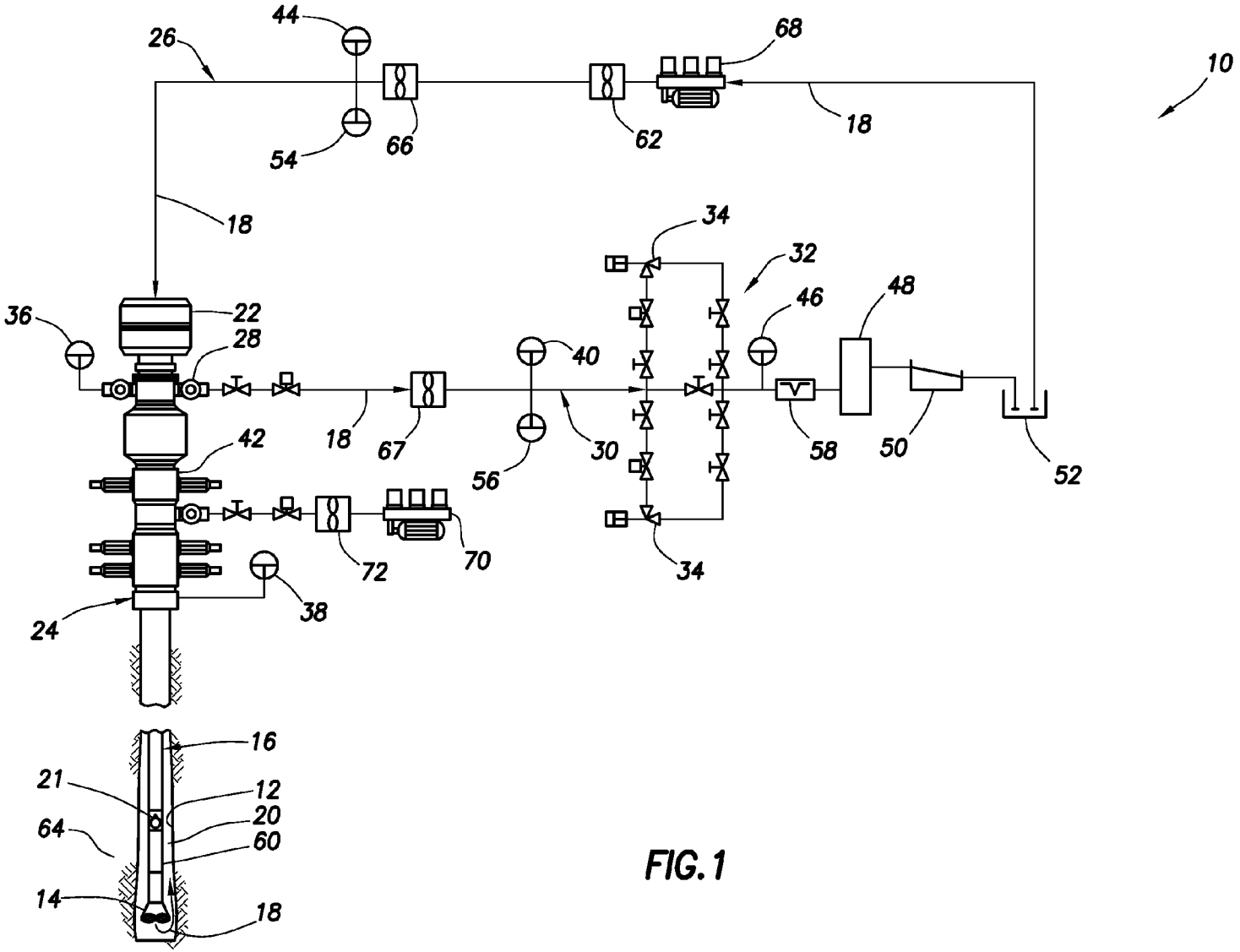
FIG. 1 is a representative partially cross-sectional view of a well system and associated method which can embody principles of the present disclosure.

Representatively and schematically illustrated in FIG. 1 is a well system 10 and associated method which can embody principles of the present disclosure. In the system 10, a wellbore 12 is drilled by rotating a drill bit 14 on an end of a tubular drill string 16.

Drilling fluid 18, commonly known as mud, is circulated downward through the drill string 16, out the drill bit 14 and upward through an annulus 20 formed between the drill string and the wellbore 12, in order to cool the drill bit, lubricate the drill string, remove cuttings and provide a measure of bottom hole pressure control. A non-return valve 21 (typically a flapper-type check valve) prevents flow of the drilling fluid 18 upward through the drill string 16 (for example, when connections are being made in the drill string).

Control of bottom hole pressure is very important in managed pressure and underbalanced drilling, and in other types of well operations. Preferably, the bottom hole pressure is accurately controlled to prevent excessive loss of fluid into an earth formation 64 surrounding the wellbore 12, undesired fracturing of the formation, undesired influx of formation fluids into the wellbore, etc.

In typical managed pressure drilling, it is desired to maintain the bottom hole pressure just greater than a pore pressure of the formation 64, without exceeding a fracture pressure of the formation. In typical underbalanced drilling, it is desired to maintain the bottom hole pressure somewhat less than the pore pressure, thereby obtaining a controlled influx of fluid from the formation 64.

Nitrogen or another gas, or another lighter weight fluid, may be added to the drilling fluid 18 for pressure control. This technique is especially useful, for example, in underbalanced drilling operations.

In the system 10, additional control over the bottom hole pressure is obtained by closing off the annulus 20 (e.g., isolating it from communication with the atmosphere and enabling the annulus to be pressurized at or near the surface) using a rotating control device 22 (RCD). The RCD 22 seals about the drill string 16 above a wellhead 24. Although not shown in FIG. 1, the drill string 16 would extend upwardly through the RCD 22 for connection to, for example, a rotary table (not shown), a standpipe line 26, a kelley (not shown), a top drive and/or other conventional drilling equipment.

The drilling fluid 18 exits the wellhead 24 via a wing valve 28 in communication with the annulus 20 below the RCD 22. The fluid 18 then flows through fluid return line 30 to a choke manifold 32, which includes redundant chokes 34. Backpressure is applied to the annulus 20 by variably restricting flow of the fluid 18 through the operative choke(s) 34.

The greater the restriction to flow through the choke 34, the greater the backpressure applied to the annulus 20. Thus, bottom hole pressure can be conveniently regulated by varying the backpressure applied to the annulus 20. A hydraulics model can be used, as described more fully below, to determine a pressure applied to the annulus 20 at or near the surface which will result in a desired bottom hole pressure, so that an operator (or an automated control system) can readily determine how to regulate the pressure applied to the annulus at or near the surface (which can be conveniently measured) in order to obtain the desired bottom hole pressure.

It can also be desirable to control pressure at other locations along the wellbore 12. For example, the pressure at a casing shoe, at a heel of a lateral wellbore, in generally vertical or horizontal portions of the wellbore 12, or at any other location can be controlled using the principles of this disclosure.

Pressure applied to the annulus 20 can be measured at or near the surface via a variety of pressure sensors 36, 38, 40, each of which is in communication with the annulus. Pressure sensor 36 senses pressure below the RCD 22, but above a blowout preventer (BOP) stack 42. Pressure sensor 38 senses pressure in the wellhead below the BOP stack 42. Pressure sensor 40 senses pressure in the fluid return line 30 upstream of the choke manifold 32.

Another pressure sensor 44 senses pressure in the standpipe line 26. Yet another pressure sensor 46 senses pressure downstream of the choke manifold 32, but upstream of a separator 48, shaker 50 and mud pit 52. Additional sensors include temperature sensors 54, 56, Coriolis flowmeter 58, and flowmeters 62, 66.

Not all of these sensors are necessary. For example, the system 10 could include only one of the flowmeters 62, 66. However, input from the sensors is useful to the hydraulics model in determining what the pressure applied to the annulus 20 should be during the drilling operation.

In addition, the drill string 16 may include its own sensors 60, for example, to directly measure bottom hole pressure. Such sensors 60 may be of the type known to those skilled in the art as pressure while drilling (PWD), measurement while drilling (MWD) and/or logging while drilling (LWD) sensor systems. These drill string sensor systems generally provide at least pressure measurement, and may also provide temperature measurement, detection of drill string characteristics (such as vibration, weight on bit, stick-slip, etc.), formation characteristics (such as resistivity, density, etc.) and/or other measurements. Various forms of telemetry (acoustic, pressure pulse, electromagnetic, optical, wired, etc.) may be used to transmit the downhole sensor measurements to the surface. The drill string 16 could be provided with conductors, optical waveguides, etc., for transmission of data and/or commands between the sensors 60 and the process control system 74 described below (and illustrated in FIG. 2).

Additional sensors could be included in the system 10, if desired. For example, another flowmeter 67 could be used to measure the rate of flow of the fluid 18 exiting the wellhead 24, another Coriolis flowmeter (not shown) could be interconnected directly upstream or downstream of a rig mud pump 68, etc.

Fewer sensors could be included in the system 10, if desired. For example, the output of the rig mud pump 68 could be determined by counting pump strokes, instead of by using flowmeter 62 or any other flowmeters.

Note that the separator 48 could be a 3 or 4 phase separator, or a mud gas separator (sometimes referred to as a "poor boy degasser"). However, the separator 48 is not necessarily used in the system 10.

The drilling fluid 18 is pumped through the standpipe line 26 and into the interior of the drill string 16 by the rig mud pump 68. The pump 68 receives the fluid 18 from the mud pit 52 and flows it via a standpipe manifold (not shown) to the standpipe line 26. The fluid 18 then circulates downward through the drill string 16, upward through the annulus 20, through the mud return line 30, through the choke manifold 32, and then via the separator 48 and shaker 50 to the mud pit 52 for conditioning and recirculation.

Note that, in the system 10 as so far, described above, the choke 34 cannot be used to control backpressure applied to the annulus 20 for control of the bottom hole pressure, unless the fluid 18 is flowing through the choke. In conventional overbalanced drilling operations, a lack of circulation can occur whenever a connection is made in the drill string 16 (e.g., to add another length of drill pipe to the drill string as the wellbore 12 is drilled deeper), and the lack of circulation will require that bottom hole pressure be regulated solely by the density of the fluid 18.

In the system 10, however, flow of the fluid 18 through the choke 34 can be maintained, even though the fluid does not circulate through the drill string 16 and annulus 20. Thus, pressure can still be applied to the annulus 20 by restricting flow of the fluid 18 through the choke 34.

In the system 10 as depicted in FIG. 1, a backpressure pump 70 can be used to supply a flow of fluid to the return line 30 upstream of the choke manifold 32 by pumping fluid into the annulus 20 when needed (such as, when connections are being made in the drill string 16). As depicted in FIG. 1, the pump 70 is connected to the annulus 20 via the BOP stack 42, but in other examples the pump 70 could be connected to the return line 30, or to the choke manifold 32.

Alternatively, or in addition, fluid could be diverted from the standpipe manifold (or otherwise from the rig pump 68) to the return line 30 when needed, as described in International application Ser. No. PCT/US08/87,686, as described in U.S. application Ser. No. 13/022,964, or using other techniques.

Restriction by the choke 34 of such fluid flow from the rig pump 68 and/or the backpressure pump 70 will thereby cause pressure to be applied to the annulus 20. If the backpressure pump 70 is implemented, a flowmeter 72 can be used to measure the output of the pump.

The choke 34 and backpressure pump 70 are examples of pressure control devices which can be used to control pressure in the annulus 20 near the surface. Other types of pressure control devices (such as those described in International application Ser. No. PCT/US08/87,686, and in U.S. application Ser. No. 13/022,964, etc.) may be used, if desired.

Figure 2:
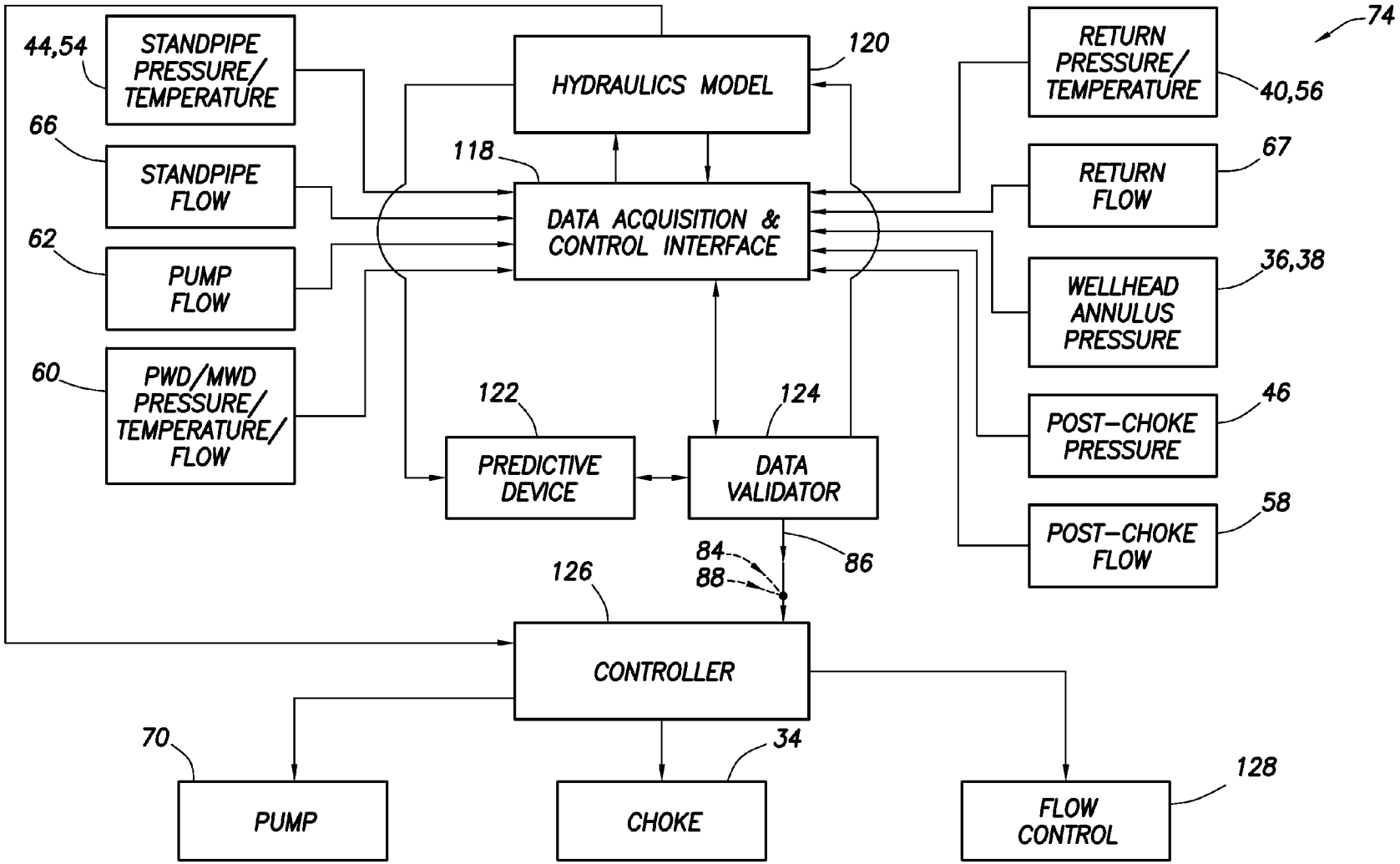
FIG. 2 is a representative illustration of a process control system which may be used with the well system and method of FIG. 1.

Referring additionally now to FIG. 2, a block diagram of one example of a process control system 74 is representatively illustrated. In other examples, the process control system 74 could include other numbers, types, combinations, etc., of elements, and any of the elements could be positioned at different locations or integrated with another element, in keeping with the scope of this disclosure.

As depicted in FIG. 2, the process control system 74 includes a data acquisition and control interface 118, a hydraulics model 120, a predictive device 122, a data validator 124 and a controller 126. These elements may be similar to those described in International application Ser. No. PCT/US10/56,433 filed on 12 Nov. 2010.

The hydraulics model 120 is used to determine a desired pressure in the annulus 20 to thereby achieve a desired pressure in the wellbore 12. The hydraulics model 120, using data such as wellbore depth, drill string rpm, running speed, mud type, etc., models the wellbore 12, the drill string 16, flow of the fluid through the drill string and annulus 20 (including equivalent circulating density due to such flow), etc.

The data acquisition and control interface 118 receives data from the various sensors 36, 38, 40, 44, 46, 54, 56, 58, 60, 62, 66, 67, 72, together with rig and downhole data, and relays this data to the hydraulics model 120 and the data validator 124. In addition, the interface 118 relays the desired annulus pressure from the hydraulics model 120 to the data validator 124.

The predictive device 122 can be included in this example to determine, based on past data, what sensor data should currently be received and what the desired annulus pressure should be. The predictive device 122 could comprise a neural network, a genetic algorithm, fuzzy logic, etc., or any combination of predictive elements to produce predictions of the sensor data and desired annulus pressure.

The data validator 124 uses these predictions to determine whether any particular sensor data is valid, whether the desired annulus pressure output by the hydraulics model 120 is appropriate, etc. If it is appropriate, the data validator 124 transmits the desired annulus pressure to the controller 126 (such as a programmable logic controller, which may include a proportional integral derivative (PID) controller), which controls operation of the choke 34, the pump 70 and the various flow control devices 128 (such as valves, etc.).

In this manner, the choke 60, pump 70 and flow control devices 128 can be automatically controlled to achieve and maintain the desired pressure in the annulus 20. Actual pressure in the annulus 20 is typically measured at or near the wellhead 24 (for example, using sensors 36, 38, 40), which may be at a land or subsea location.

Figure 3:
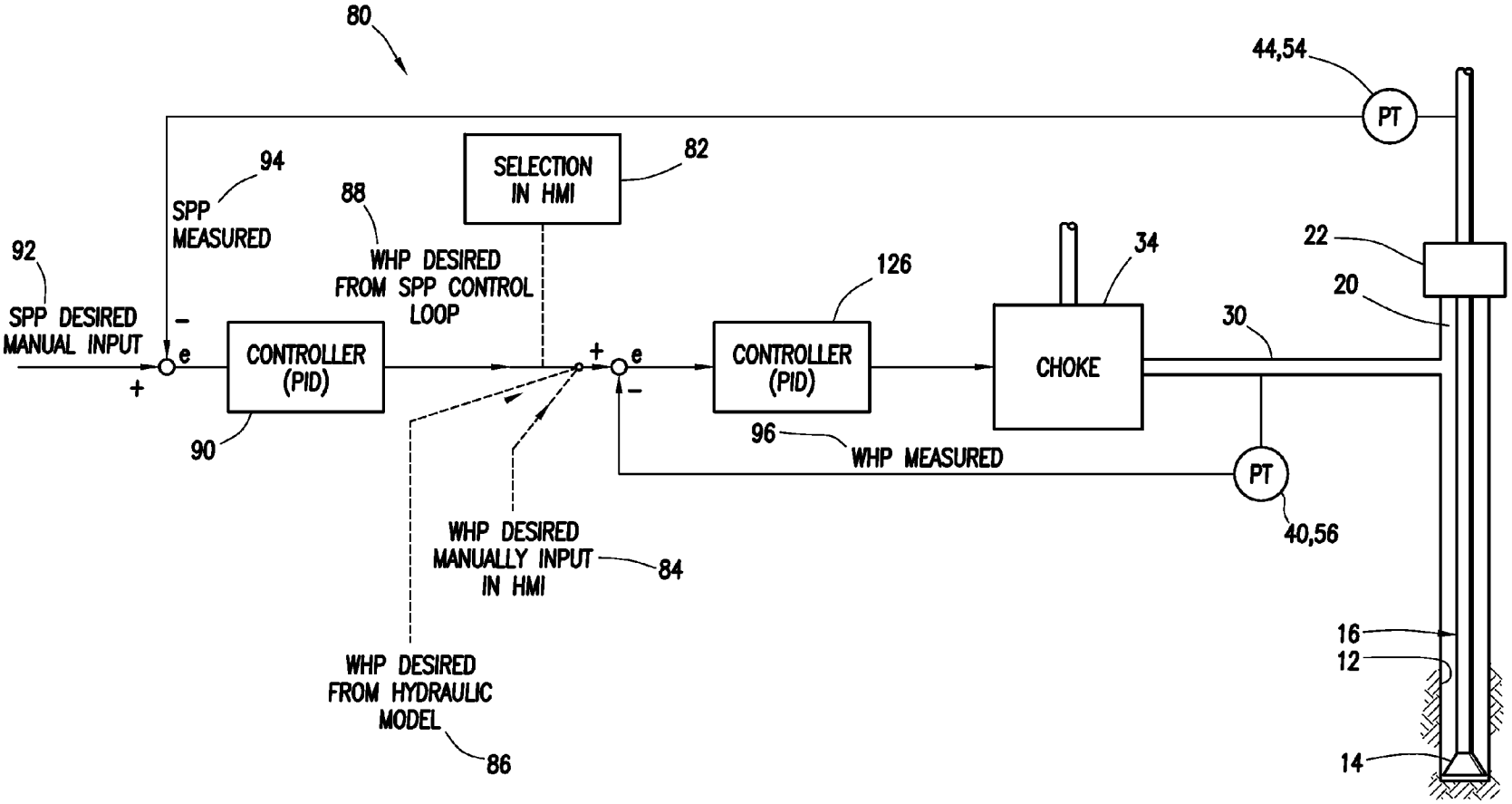
FIG. 3 is a representative illustration of a standpipe pressure control system which may be used with the well system, method and process control system.

Referring additionally now to FIG. 3, representatively illustrated in schematic form is a standpipe pressure control system 80 which may be used with the well system 10 and/or process control system 74. Of course, the standpipe pressure control system 80 may be used with other well systems and other process control systems, in keeping with the principles of this disclosure.

In the example depicted in FIG. 3, the controller 126 can be used to control operation of the choke 34 based on a selected one of three possible annulus pressure setpoint sources. The selection of the annulus pressure setpoint source is performed by an operator using a human-machine interface (HMI) 82, such as an appropriately configured computer, monitor, etc., and/or event detection software.

The annulus pressure setpoint source can be selected via the HMI 82, or can be selected automatically by control logic.

Annulus pressure is sometimes referred to as wellhead pressure, since it is commonly measured at or near the wellhead 24. However, in some situations (such as subsea drilling operations, etc.), pressure in the annulus 20 may not be measured at the wellhead 24, or at least pressure in the annulus 20 measured at the wellhead may not be used for controlling pressure in the wellbore 12. For example, pressure in the annulus 20 measured at a surface location, floating or semi-submersible rig, etc., may possibly be used for controlling pressure in the wellbore 12. In this description, wellhead pressure is assumed to be synonymous with annulus pressure, but it should be clearly understood that in other examples, the annulus pressure may not be measured at the wellhead, or such a wellhead pressure measurement may not be used for controlling wellbore pressure.

Using the human-machine interface 82, the operator can select to control wellbore pressure using either a wellhead pressure (WHP) setpoint 84 manually input to the human-machine interface, a wellhead pressure setpoint 86 which results from the process control system 74 as described above, or a wellhead pressure setpoint 88 output from a controller 90.

The controller 126 can include a proportional integral differential controller (PID) and can be implemented in a programmable logic controller (PLC) of the types well known to those skilled in the art. The proportional integral differential controller operates based on a difference e between the selected wellhead pressure setpoint 84, 86 or 88, and the measured wellhead pressure (e.g., using sensors 36, 38 or 40).

The proportional integral differential controller determines if or how the choke 34, pump 70, other flow control devices 128, etc., should be adjusted to minimize the difference e. The programmable logic controller adjusts the choke 34, etc., based on the output of the proportional integral differential controller. Of course, process control devices other than a proportional integral differential controller and/or a programmable logic controller may be used, if desired.

The wellhead pressure setpoint 88 is selected by the operator if the operator desires to control wellbore pressure based on pressure measured in the standpipe line 26 (e.g., measured using sensor 44). One situation in which this may be desired is in a well control procedure, for example, following an influx of fluid into the wellbore 12 from the formation 64.

The controller 90 (which may comprise a proportional integral differential controller) receives a difference e between a desired standpipe pressure (SPP) 92, which may be manually input via the human-machine interface 82, and the measured standpipe pressure 94 (e.g., measured using the pressure sensor 44). The controller 90 determines if or how the wellhead pressure should be adjusted to minimize the difference e, and outputs the appropriate desired wellhead pressure setpoint 88 for selection using the human-machine interface 82.

Preferably, the controllers 90, 126 operate via cascade control, with an outer loop (including the controller 90 and sensor 44) for controlling the standpipe pressure, and an inner loop (including the controller 126, sensor 40, choke 34, pump 70 and other flow control devices 128) for controlling the wellhead pressure. More preferably, the dynamics of the inner loop (e.g., frequency of comparisons between the measured wellhead pressure 96 and the selected wellhead pressure setpoint 88) is at least four times the dynamics of the outer loop (e.g., frequency of comparisons between the measured standpipe pressure 94 and the desired standpipe pressure 92).

The proportional integral differential controller of the controller 90 may base its calculations on the following equation 1:

$$u_k = u_{k-1} + K_p(e_k - e_{k-1}) + \frac{K_p T_s}{T_i} e_k + \frac{K_p T_d}{T_s}(e_k - 2e_{k-1} + e_{k-2}) \quad (1)$$

in which u is the output wellhead pressure setpoint 88, k is a sequence indicator (with k being a present sample, k-1 being a next previous sample, k-2 being two samples previous), $K_p$ is a gain for the controller 90, $T_s$ is a sampling interval, $T_d$ is a derivative time, $T_i$ is an integral time, and e is the difference between the desired standpipe pressure 92 and the measured standpipe pressure 94.

Figure 4:
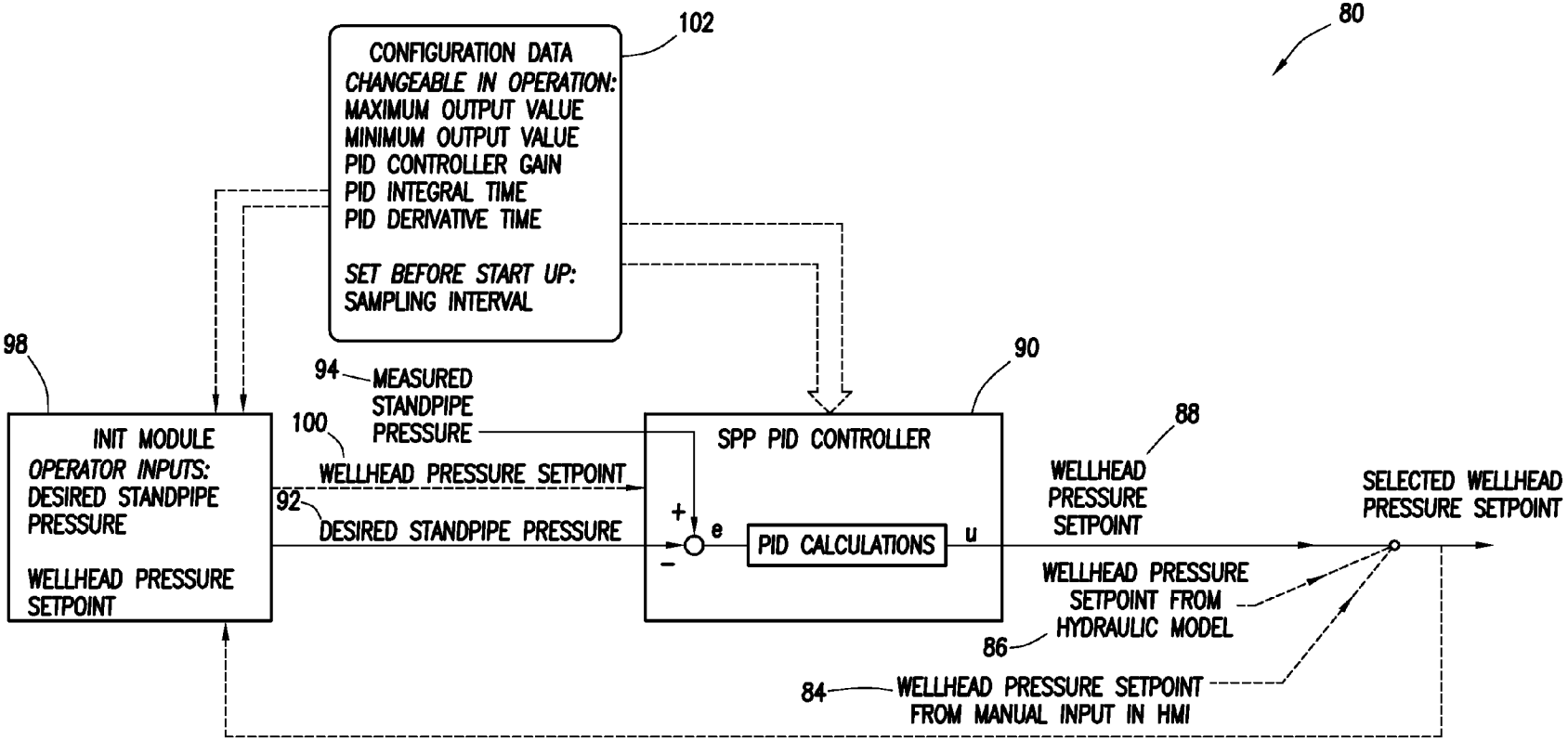
FIG. 4 is a representative illustration of a portion of the standpipe pressure control system.

Referring additionally now to FIG. 4, a schematic view of a portion of the standpipe pressure control system 80 is representatively illustrated. In this view, it may be seen that the controller 90 receives the desired standpipe pressure 92 from an initialization module 98.

The module 98 supplies the controller 90 with initial values for certain variables at startup. The desired standpipe pressure 92 is preferably input via the human-machine interface 82. Alternatively, an initial wellhead pressure setpoint 100 can be supplied to the controller 90 by the module 98. The initial wellhead pressure setpoint 100 may be based on the last wellhead pressure setpoint 88 supplied to the controller 126 by the controller 90.

Certain configuration data 102 can be input by an operator via the human-machine interface 82 and supplied to the module 98 and controller 90. The data 102 may include maximum and minimum allowable values for the controller 90 output, the controller gain, the integral and derivative times, and the sampling interval. Preferably, all of these variables (with the exception of the sampling interval) can be changed by the operator during the pressure control operation.

The predictive device 122 and data validator 124 can be used to validate the wellhead pressure setpoint 88 output by the controller 90. In this manner, an erroneous or out-of-range wellhead pressure setpoint 88 can be prevented from being input to the controller 126.

The standpipe pressure is actually being controlled when the wellhead pressure setpoint 88 generated by the controller 90 is selected for use by the controller 126 to control wellhead pressure. This is because the wellhead pressure setpoint 88 is adjusted by the controller 90 to minimize the difference e between the desired standpipe pressure 92 and the measured standpipe pressure 94. Thus, the choke 34, pump 70 and/or other flow control devices 128 are controlled by the controller 126, so that the standpipe pressure is maintained at the desired level.

It can now be fully appreciated that this disclosure provides several advancements to the art of controlling wellbore pressure. The standpipe pressure control system 80 described above can be used to regulate operation of a process control system 74, hereby a desired standpipe pressure 92 maintained.

The above disclosure provides to the art a method of controlling standpipe pressure in a drilling operation. The method can include comparing a measured standpipe pressure 94 to a desired standpipe pressure 92, and automatically adjusting a choke 34 in response to the comparing, thereby reducing a difference e between the measured standpipe pressure 94 and the desired standpipe pressure 92.

The choke 34 receives fluid 18 while a rig pump 68 pumps the fluid through a drill string 16. Automatically adjusting the choke 34 can include a controller 90 outputting an annulus pressure setpoint 88. The controller 90 may comprise a proportional integral differential controller.

Automatically adjusting the choke 34 can also include comparing a measured annulus pressure 96 to the annulus pressure setpoint 88, and automatically adjusting the choke 34 so that a difference e between the measured annulus pressure 96 and the annulus pressure setpoint 88 is reduced. Comparing the measured annulus pressure 96 to the annulus pressure setpoint 88 may be performed at least four times as frequent as comparing the measured standpipe pressure 94 to the desired standpipe pressure 92.

Also described above is a standpipe pressure control system 80 for use in a drilling operation. The system 80 can include a controller 90 which outputs an annulus pressure setpoint 88 based on a comparison of a measured standpipe pressure 94 to a desired standpipe pressure 92, and a choke 34 which is automatically adjusted in response to the annulus pressure setpoint 88.

Automatic adjustment of the choke 34 preferably reduces a difference e between the measured standpipe pressure 94 and the desired standpipe pressure 92.

Another controller 126 may compare a measured annulus pressure 96 to the annulus pressure setpoint 88. Automatic adjustment of the choke 34 preferably reduces a difference e between the measured annulus pressure 96 and the annulus pressure setpoint 88.

The measured annulus pressure 96 is preferably compared to the wellhead pressure setpoint 88 at least four times as frequent as the measured standpipe pressure 94 is compared to the desired standpipe pressure 92.

The above disclosure also describes a well system 10 which can include a standpipe line 26 connected to a drill string 16 in a wellbore 12, a sensor 44 which measures pressure in the standpipe line 26, and a controller 90 which outputs an annulus pressure setpoint 88 based at least in part on a difference e between the measured pressure 94 and a desired standpipe pressure 92.

It is to be understood that the various embodiments of the present disclosure described herein may be utilized in various orientations, such as inclined, inverted, horizontal, vertical, etc., and in various configurations, without departing from the principles of the present disclosure. The embodiments are described merely as examples of useful applications of the principles of the disclosure, which is not limited to any specific details of these embodiments.

Of course, a person skilled in the art would, upon a careful consideration of the above description of representative embodiments of the disclosure, readily appreciate that many modifications, additions, substitutions, deletions, and other changes may be made to the specific embodiments, and such changes are contemplated by the principles of the present disclosure. Accordingly, the foregoing detailed description is to be clearly understood as being given by way of illustration and example only, the spirit and scope of the present invention being limited solely by the appended claims and their equivalents.

What is claimed is:

1. A method of controlling standpipe pressure in a drilling operation, the method comprising:

comparing a measured standpipe pressure to a desired standpipe pressure while elongating a wellbore;

outputting an annulus pressure set point based on the comparing; and automatically adjusting a choke in response to the outputting, thereby reducing a difference between the measured standpipe pressure and the desired standpipe pressure.

2. The method of claim 1, wherein the choke receives fluid while a rig pump pumps the fluid through a drill string.

3. The method of claim 1, wherein automatically adjusting the choke further comprises a controller outputting an annulus pressure setpoint.

4. The method of claim 3, wherein automatically adjusting the choke further comprises comparing a measured annulus pressure to the annulus pressure setpoint, and automatically adjusting the choke so that a difference between the measured annulus pressure and the annulus pressure setpoint is reduced.

5. The method of claim 4, wherein comparing the measured annulus pressure to the annulus pressure setpoint is performed at least four times as frequent as comparing the measured standpipe pressure to the desired standpipe pressure.

6. The method of claim 3, wherein the controller comprises a proportional integral differential controller.

7. A standpipe pressure control system for use in a drilling operation, the system comprising:

a first controller which outputs an annulus pressure setpoint based on a comparison of a measured standpipe pressure to a desired standpipe pressure; and a choke which is automatically adjusted in response to the annulus pressure setpoint, wherein automatic adjustment of the choke reduces a difference between the measured standpipe pressure and the desired standpipe pressure.

8. The system of claim 7, wherein the choke receives fluid while a rig pump pumps the fluid through a drill string.

9. The system of claim 7, wherein a second controller compares a measured annulus pressure to the annulus pressure setpoint.

10. The system of claim 9, wherein automatic adjustment of the choke reduces a difference between the measured annulus pressure and the annulus pressure setpoint.

11. A standpipe pressure control system for use in a drilling operation, the system comprising:

a first controller which outputs an annulus pressure setpoint based on a comparison of a measured standpipe pressure to a desired standpipe pressure; and a choke which is automatically adjusted in response to the annulus pressure setpoint, wherein a second controller compares a measured annulus pressure to the annulus pressure setpoint, and wherein the measured annulus pressure is compared to the annulus pressure setpoint at least four times as frequent as the measured standpipe pressure is compared to the desired standpipe pressure.

12. A standpipe pressure control system for use in a drilling operation, the system comprising:

a controller which outputs an annulus pressure setpoint based on a comparison of a measured standpipe pressure to a desired standpipe pressure; and a choke which is automatically adjusted in response to the annulus pressure setpoint, wherein the controller comprises a proportional integral differential controller.

13. A well system, comprising:

a standpipe line connected to a drill string in a wellbore;

a sensor which measures pressure in the standpipe line;

a first controller which outputs an annulus pressure setpoint based at least in part on a difference between the measured pressure and a desired standpipe pressure; and a choke which is automatically adjusted in response to the annulus pressure setpoint, wherein automatic adjustment of the choke reduces the difference between the measured pressure and the desired standpipe pressure.

14. The system of claim 13, wherein a second controller compares a measured annulus pressure to the annulus pressure setpoint.

15. The system of claim 14, wherein automatic adjustment of the choke reduces a difference between the measured annulus pressure and the annulus pressure setpoint.

16. A well system, comprising:

a standpipe line connected to a drill string in a wellbore;

a sensor which measures pressure in the standpipe line; and a first controller which outputs an annulus pressure setpoint based at least in part on a difference between the measured pressure and a desired standpipe pressure, wherein a second controller compares a measured annulus pressure to the annulus pressure setpoint, and wherein the measured annulus pressure is compared to the annulus pressure setpoint at least four times as frequent as the measured standpipe pressure is compared to the desired standpipe pressure.

17. A well system, comprising:

a standpipe line connected to a drill string in a wellbore;

a sensor which measures pressure in the standpipe line; and a controller which outputs an annulus pressure setpoint based at least in part on a difference between the measured pressure and a desired standpipe pressure, wherein the controller comprises a proportional integral differential controller.

* * * * *